US009380844B1

(12) United States Patent
Luo

(10) Patent No.: US 9,380,844 B1
(45) Date of Patent: Jul. 5, 2016

(54) ADJUSTABLE UMBRELLA

(71) Applicant: Phaeton Manufacturing LLC, Nantong (CN)

(72) Inventor: Xiong Luo, Nantong (CN)

(73) Assignee: Phaeton Manufacturing LLC, Nantong (CN)

( * ) Notice: Subject to any disclaimer, the term of this patent is extended or adjusted under 35 U.S.C. 154(b) by 0 days.

(21) Appl. No.: 14/643,767

(22) Filed: Mar. 10, 2015

(30) Foreign Application Priority Data

Dec. 12, 2014 (CN) ..... 2014 1 0768149

(51) Int. Cl.
*A45B 23/00* (2006.01)

(52) U.S. Cl.
CPC ..... *A45B 23/00* (2013.01); *A45B 2023/0012* (2013.01); *A45B 2023/0031* (2013.01); *A45B 2023/0075* (2013.01)

(58) Field of Classification Search
CPC ..... A45B 23/00; A45B 2023/0031; A45B 2023/0037; A45B 2023/0081
USPC ..... 135/20.1, 21
See application file for complete search history.

(56) References Cited

U.S. PATENT DOCUMENTS

| | | | | |
|---|---|---|---|---|
| 6,588,438 | B1 * | 7/2003 | Steiner | 135/20.1 |
| 7,156,114 | B2 * | 1/2007 | Lo | 135/21 |
| 7,398,790 | B2 * | 7/2008 | Glatz | 135/20.1 |
| 2003/0010366 | A1 * | 1/2003 | Glatz | 135/21 |
| 2014/0311537 | A1 * | 10/2014 | Ma | 135/20.1 |

FOREIGN PATENT DOCUMENTS

| | | | | |
|---|---|---|---|---|
| DE | 102008034985 | A1 * | 2/2010 | A45B 23/00 |
| DE | 202013007893 | U1 * | 1/2014 | |
| FR | 2992834 | A1 * | 1/2014 | |

* cited by examiner

*Primary Examiner* — Noah Chandler Hawk
(74) *Attorney, Agent, or Firm* — Wang Law Firm, Inc.

(57) ABSTRACT

An adjustable umbrella includes an umbrella base, a stand column, a sliding sleeve, a cross rod, an adjustment mechanism provided between the bottom joint and the bottom end of the cross rod, a drawing rod, and an umbrella frame. The top of the umbrella frame is rotatably attached to the top end of the cross rod, an internal tube is rotatably disposed inside the cross rod, the bottom end of the internal tube is connected to the adjustment mechanism, the top end of the internal tube is connected to the top of the umbrella frame. When in use, the internal tube connected to the umbrella frame may be rotated by rotating the umbrella frame, so that the leftward and rightward adjustment of a sun-shading angle is realized in coordination with the adjusting mechanism, and operation thereof is simple and convenient.

8 Claims, 8 Drawing Sheets

ADJUSTABLE UMBRELLA

RELATE APPLICATIONS

This application claims the benefit of Chinese Application 201410768149.4, filed on Dec. 12, 2014 with the State Intellectual Property Office of the People's Republic of China, the specification of which is incorporated herein by reference.

FIELD OF THE INVENTION

The present invention relates to the technical field of an outdoor sunshade, particularly to an adjustable umbrella capable of adjusting shading angle.

DESCRIPTION OF THE PRIOR ART

As one of outdoor recreation tools, sunshades are widely applied in squares, beaches, parks, courtyards and other leisure places for purpose of providing a comfortable cool environment for people. The positions of umbrella covers of most sunshades in the current market are generally fixed and cannot be adjusted. However, in an outdoor environment, the wind direction and the irradiation angle of the sun will change over time, so a sunshade needs to be adjusted the shading angle as required. Chinese Patent CN203538551U (with the Application No. 201320541314.3), entitled Sunshade with Leftwards and Rightwards Adjustable Sun-shading Angle, has disclosed such a configuration. The Sunshade comprises an umbrella base, a stand column, a cross rod, a drawing rod and an umbrella frame, wherein the lower end of the cross rod is arranged on the stand column, while the upper end of the cross rod is connected to the top of the umbrella frame; the back end of the drawing rod is mounted on the top of the stand column, while the front end of the stand column is connected to the middle part of the cross rod; the stand column is inserted on the umbrella base; the top of the umbrella frame is rotatably connected to the upper end of the cross rod through a rotating mechanism; a sliding sleeve is sleeved on the stand column; the lower end of the cross rod is connected to the sliding sleeve through a lower cross rod joint; an umbrella cover adjusting mechanism is arranged between the lower joint and the cross rod; the umbrella frame is provided with a lengthened umbrella rib; and, the lower end of the lengthened umbrella rib is connected to the umbrella cover adjusting mechanism. When in use, the shading angle can be adjusted through the adjusting mechanism, so it is easy and convenient to operate.

SUMMARY OF THE INVENTION

It is an object of the present invention to provide a sunshade with a new configuration that can also adjust the shading angle of the umbrella leftward and rightward, and is easy and convenient to operate.

For achieving the above stated object, an adjustable umbrella, comprises: an umbrella base; a stand column removably connected to the umbrella base, the stand column having a top; a sliding sleeve slidably connected to the stand column; a cross rod, movably connected to the sliding sleeve and slidable relative to the stand column, having a bottom end, a top end, and a bottom joint, the bottom joint being disposed on the bottom end of the cross rod; an adjustment mechanism is provided between the bottom joint and the bottom end of the cross rod; a drawing rod having a first end and a second end, the first end of the drawing rod rotatably connected to the top of the stand column, the second end of the drawing rod rotatably connected to the cross rod; and an umbrella frame with a top, wherein the top of the umbrella frame is rotatably attached to the top end of the cross rod, the bottom joint of the cross rod is rotatably connected to the sliding sleeve, an internal tube is rotatably disposed inside the cross rod, the internal tube has a top end and a bottom end, the bottom end of the internal tube is connected to the adjustment mechanism, the top end of the internal tube is connected to the top of the umbrella frame.

As a preference, the adjustment mechanism comprises an upper toothed cylindrical clutch with a rear end, an outer wall, and an inner wall, a lower toothed cylindrical clutch with a front end and a rear end, and a spring; the bottom joint has a front that extends forwards to form an extension portion, the lower toothed cylindrical clutch slides over the extension portion of the bottom joint and is capable of moving along the axis of the extension portion, the upper toothed cylindrical clutch is connected to the front end of the lower toothed cylindrical clutch and slides over the extension portion, the front end of the lower toothed cylindrical clutch has a recess with an inner wall for receiving the rear end of the upper toothed cylindrical clutch, the inner wall of the recess and the outer wall of the upper toothed cylindrical clutch are provided with matching looped teeth; the spring slides over the extension portion and is disposed between the bottom joint and the rear end of the lower toothed cylindrical clutch, the spring is able to move the lower toothed cylindrical clutch to engage the upper toothed cylindrical clutch.

As a preference, the bottom end of the cross rod slides over the bottom joint, the upper toothed cylindrical clutch, the lower toothed cylindrical clutch and the spring are inserted inside the cross rod; the adjustment mechanism further comprises a first collar, the first collar engages the lower toothed cylindrical clutch by a pin, a groove is formed on the cross rod for the pin to move along the axis of the cross rod.

As a preference, the adjustment mechanism further comprise a handle with an inner wall, the handle slides outside the first collar, the first collar and the handle each has an interface surface and both interface surfaces are provided with matching screw threads.

In the above solution, the extension portion is composed of a first connecting portion connected to the front of the bottom joint, and a second connecting portion connected to the first connecting portion, the first connecting portion has a front surface, the second connecting portion has a front end; the upper toothed cylindrical clutch slides over the second connecting portion, and the upper toothed cylindrical clutch has a back surface that matches with the front surface of the first connecting portion after assembled; the front end of the second connecting portion is engaged with a positioning nut for preventing the upper toothed cylindrical clutch from moving axially along the second connection portion.

Preferably, the inner wall of the upper toothed cylindrical clutch is provided with two annular grooves, each groove receives a bearing for fastening connection.

In order to prevent the circumferential rotation of the lower toothed cylindrical clutch around the first connection portion, the first connecting portion has a polygonal shape, and the lower toothed cylindrical clutch has an inner wall in polygonal shape for matching with the first connecting portion.

Preferably, the umbrella frame has a hinge on the top, the hinge has a connecting portion, the connecting portion is formed with an inserting portion capable of rotatably connecting to the cross rod, and the top end of the internal tube is inserted into the connecting portion and fixed.

Preferably, the top end of the cross rod is rotatably provided with a second collar, and the second collar is fixed with the internal tube; the umbrella frame has a hinge on the top, the hinge has a connecting portion, and the top end of the internal tube is inserted into the connecting portion and fixed.

Compared with the prior art, in the present invention, the umbrella frame is rotatably attached to the top end of the cross rod via the internal tube, the adjustment mechanism is provided between the bottom joint and the bottom end of the cross rod, and the bottom end of the internal tube is connected to the adjustment mechanism, that is the bottom joint of the cross rod is fixedly connected to the cross rod, and the umbrella frame is rotatably connected to the adjusting mechanism via the internal tube. Therefore, when in use, the internal tube connected to the umbrella frame may be rotated by rotating the umbrella frame, so that the leftward and rightward adjustment of a sun-shading angle is realized through the adjusting mechanism, and the operation is simple and convenient.

DETAILED DESCRIPTION OF THE PREFERRED EMBODIMENT

Figure 1:
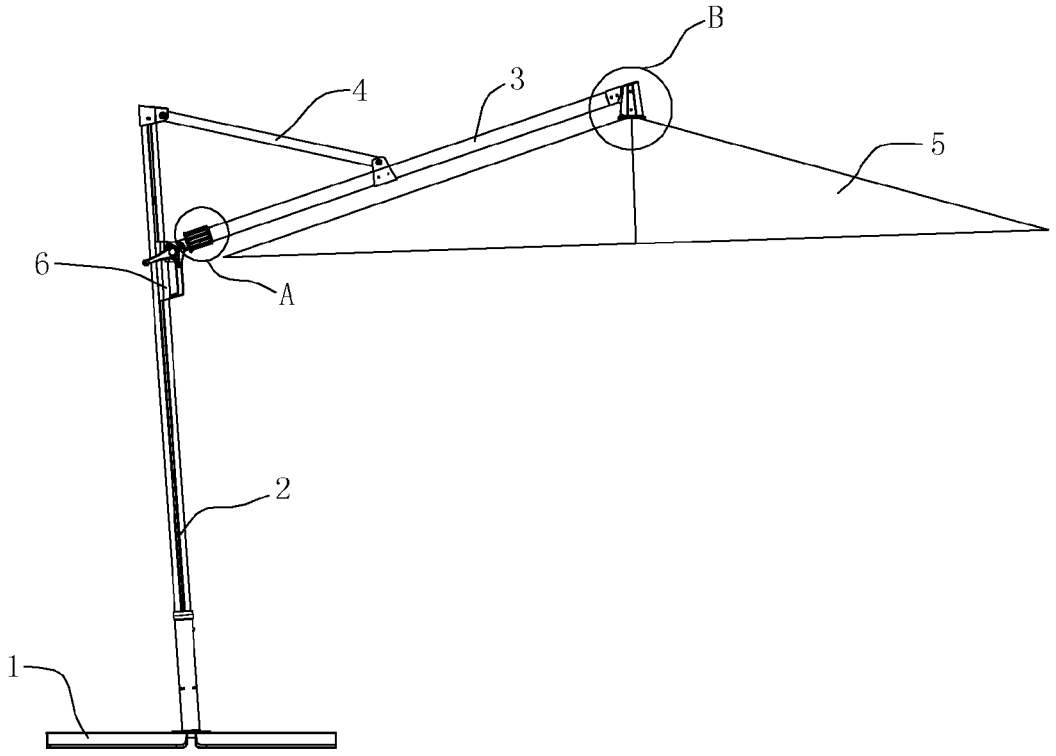
FIG. 1 is a view of an adjustable umbrella in accordance with the first embodiment of the present invention.
Figure 2:
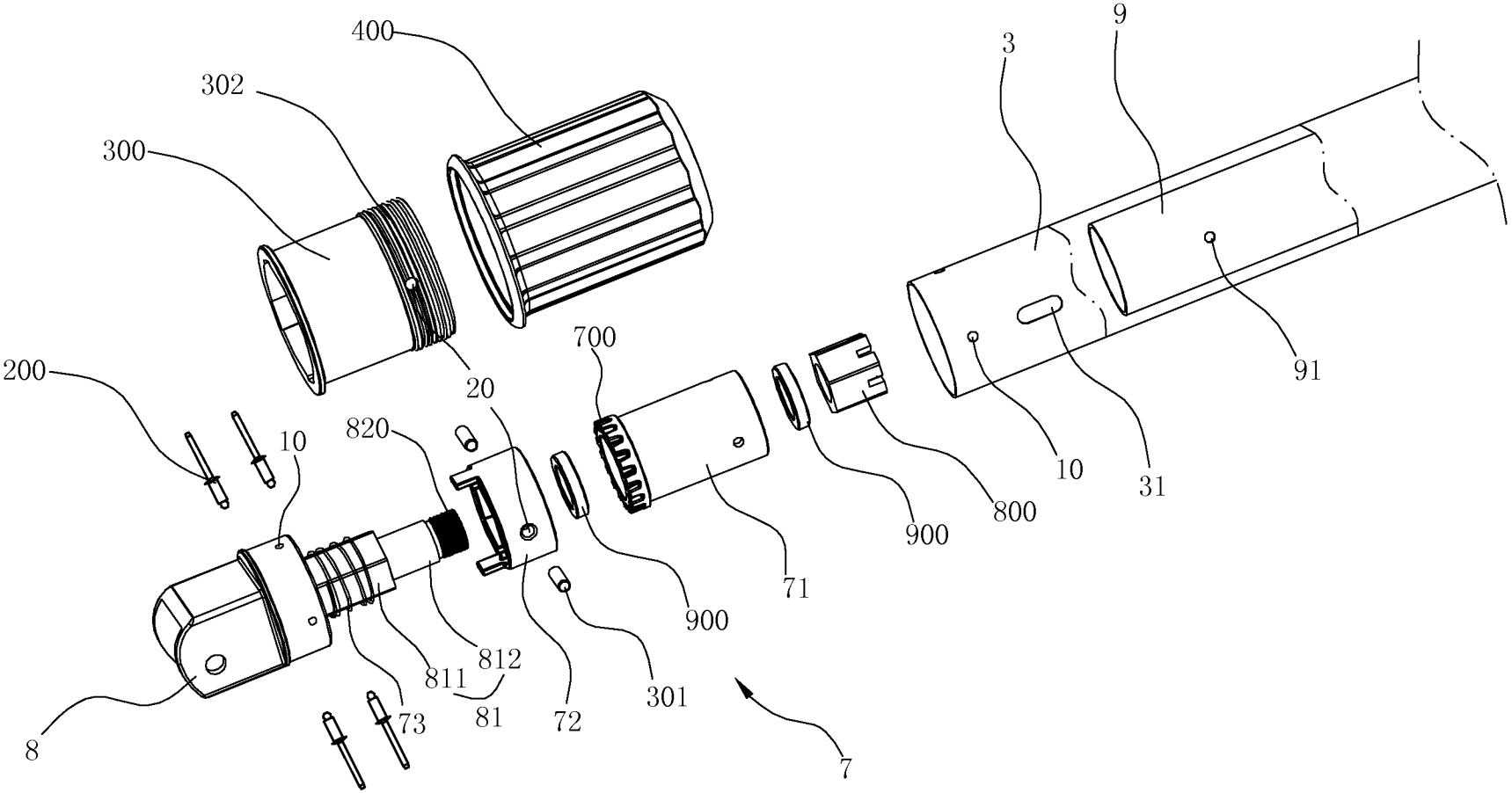
FIG. 2 is an exploded view of region-A in FIG. 1.
Figure 3:
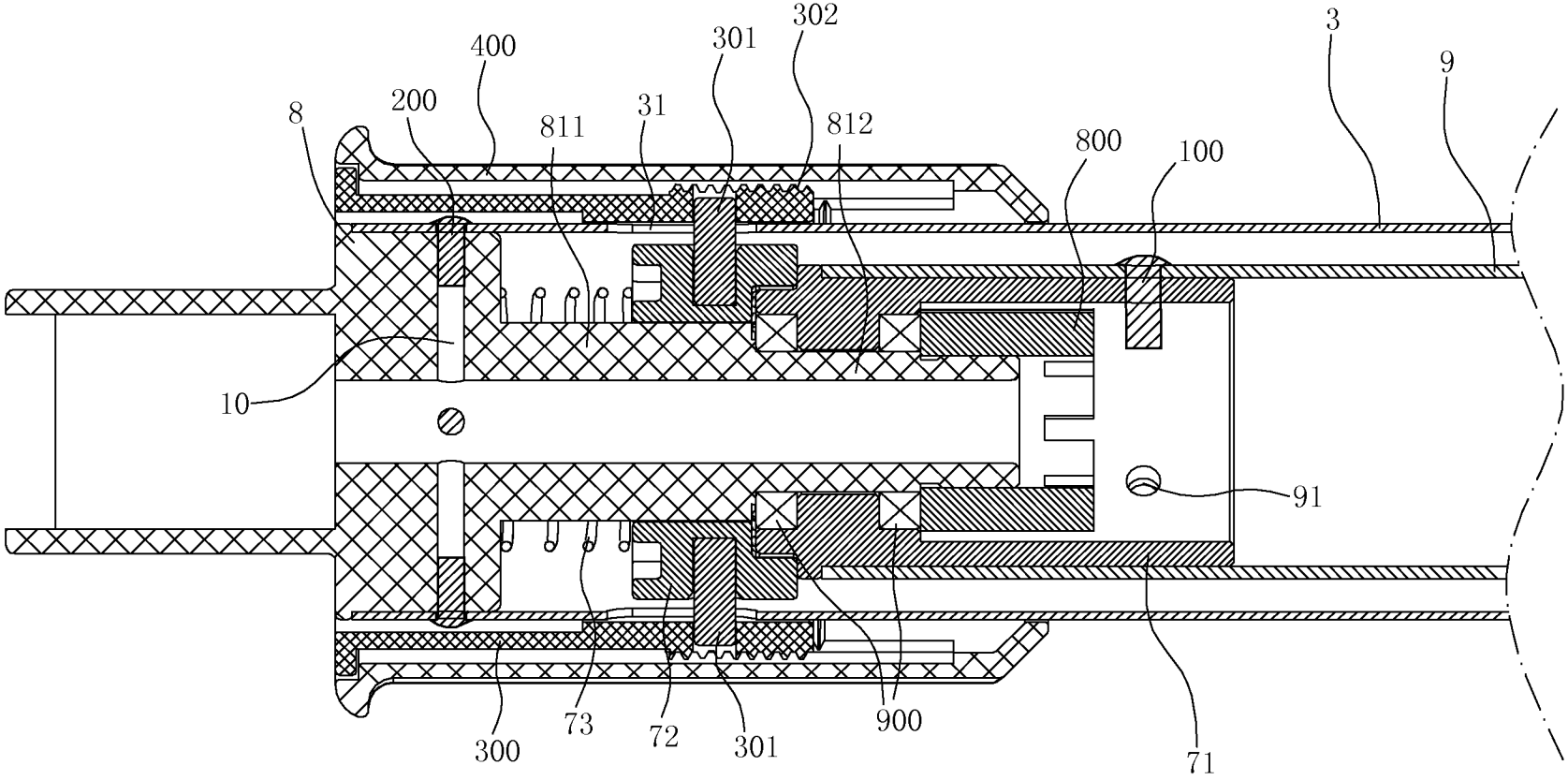
FIG. 3 is a sectional view of region-A in FIG. 1.
Figure 4:
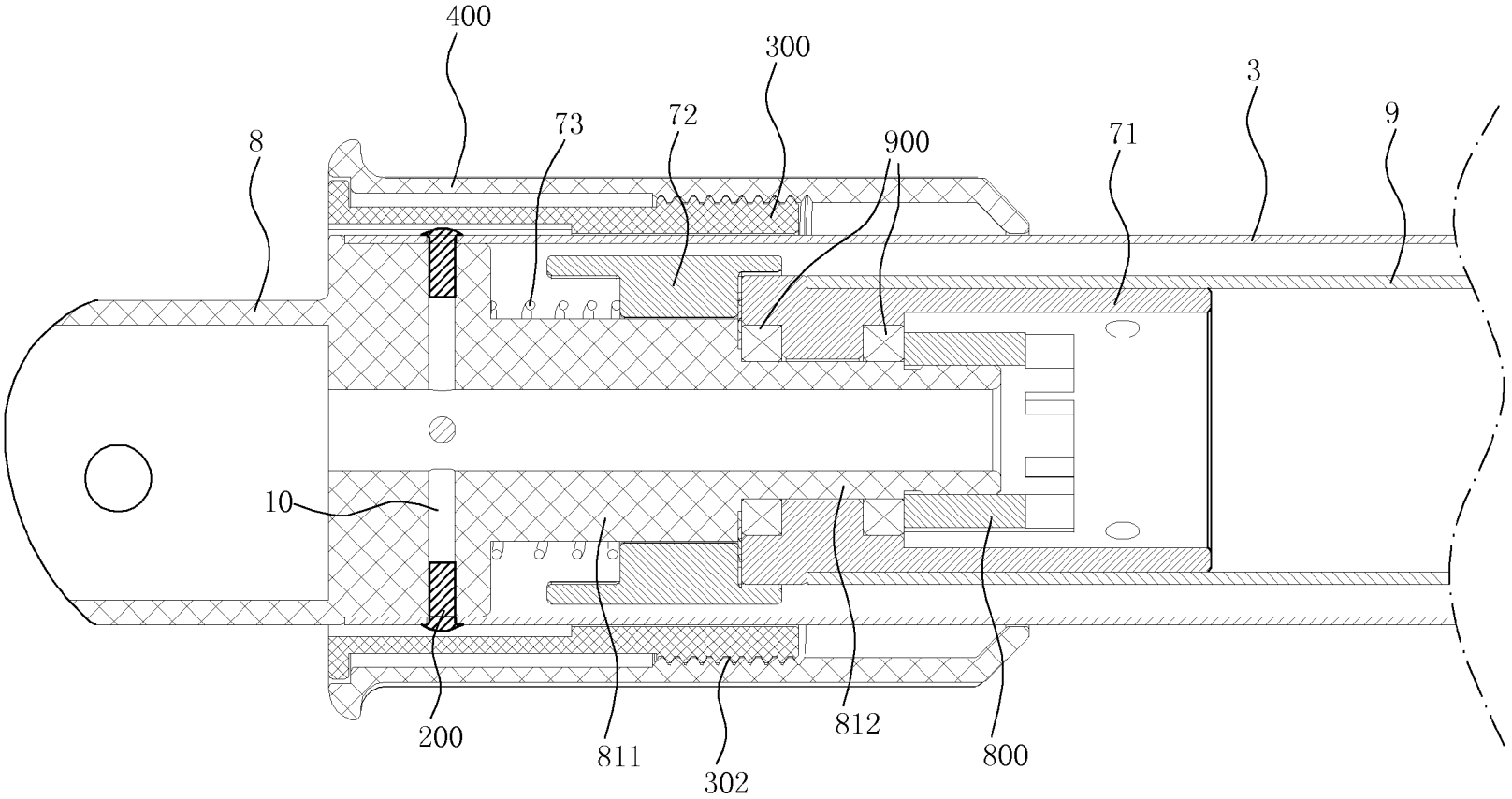
FIG. 4 is another sectional view of region-A in FIG. 1.
Figure 5:
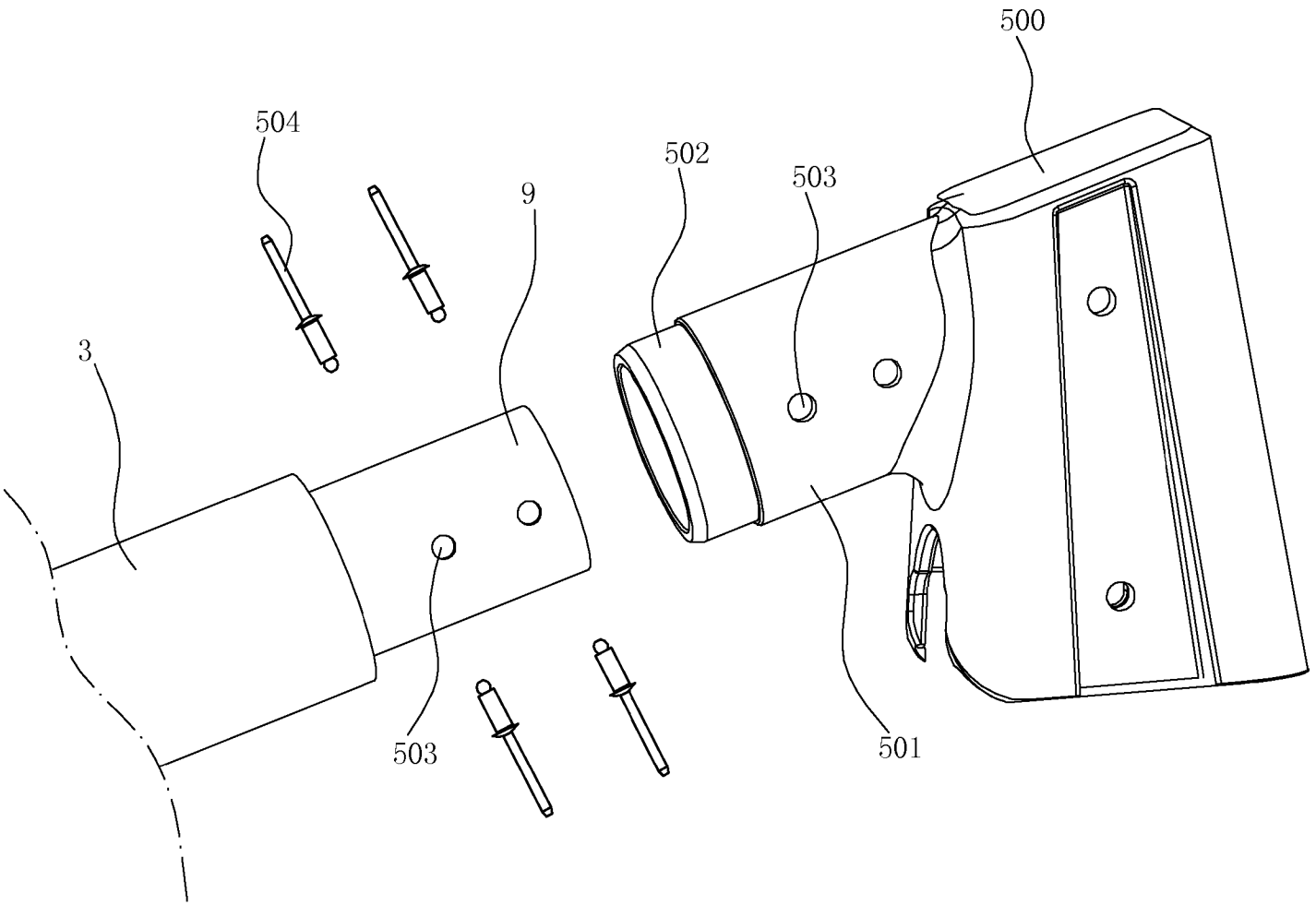
FIG. 5 is an exploded view of region-B in FIG. 1.

To enable a further understanding of the innovative and technological content of the invention herein, refer to the detailed description of the invention and the accompanying drawings below:

Embodiment 1

As shown in FIGS. 1-5, an adjustable umbrella, comprises an umbrella base 1, a stand column 2, a cross rod 3, a drawing rod 4, an umbrella frame 5, a sliding sleeve 6, a bottom joint 8, an internal tube 9 and an adjusting mechanism 7 for adjusting the shading angle. The umbrella base 1 is supported on the ground, and the stand column 2 is vertically connected to the umbrella base 1, the stand column 2 in this embodiment is an unconventional tube, the sliding sleeve 6 is slidably connected to the stand column 2; the cross rod 3 is movably connected to the sliding sleeve 6 via the bottom joint 8, and the bottom joint 8 of the cross rod 3 is rotatably connected to the sliding sleeve 6, the top of the umbrella frame 5 is rotatably attached to the top end of the cross rod 3; the drawing rod 4 has a first end and a second end, the first end of the drawing rod 4 is rotatably connected to the top of the stand column 2, the second end of the drawing rod 4 is rotatably connected to the cross rod 3.

In this embodiment, the adjusting mechanism 7 is provided between the bottom joint 8 and the bottom end of the cross rod 3; the cross rod 3 is a hollow circular tube, the internal tube 9 can be rotatably disposed inside the cross rod 3, the internal tube has a top end and a bottom end, the bottom end of the internal tube 9 is connected to the adjustment mechanism 7, the top end of the internal tube 9 is connected to the top of the umbrella frame 5. The adjustment mechanism 7 comprises an upper toothed cylindrical clutch 71, a lower toothed cylindrical clutch 72 and a spring 73. The bottom joint 8 has a front that extends forwards to form an extension portion 81, the extension portion 81 is composed of a first connecting portion 811 connected to the front of the bottom joint 8, and a second connecting portion 812 connected to the first connecting portion 811; the outer diameter of the lower cross joint 8, the outer diameter of the first connecting portion 811 and the outer diameter of the second extension portion 812 decrease in turn, the first connecting portion 811 has a polygonal shape, and the lower toothed cylindrical clutch 72 has an inner wall in polygonal shape for matching with the first connecting portion 811, thereby preventing the circumferential rotation of the lower toothed cylindrical clutch 72 around the first connecting portion 811; the lower toothed cylindrical clutch 72 slides over the first connecting portion 811 and is capable of moving along the axis of the first connecting portion 811. The upper toothed cylindrical clutch 71 slides over the second connecting portion 812, and the upper toothed cylindrical clutch 71 has a back surface that matches with the front surface of the first connecting portion 811 after assembled; the front end of the lower toothed cylindrical clutch 72 has a recess with an inner wall for receiving the rear end of the upper toothed cylindrical clutch 71, the inner wall of the recess and the outer wall of the upper toothed cylindrical clutch 71 are provided with matching looped teeth 700. The internal tube 9 is an internally hollow circular tube, the bottom end of the internal tube 9 slides over the upper toothed cylindrical clutch 71, and the bottom end of the internal tube 9 and the upper toothed cylindrical clutch 71 are respectively provided with multiple first connecting holes 91, each first pin 100 passes through the first connecting holes 91 of the upper toothed cylindrical clutch 71 and corresponding first connecting holes 91 of the internal tube 9 to connect the upper toothed cylindrical clutch 71 to the internal tube 9. The spring 73 slides over the first connecting portion 811 and is disposed between the bottom joint 8 and the rear end of the lower toothed cylindrical clutch 72, the spring 73 is able to move the lower toothed cylindrical clutch 72 to engage the upper toothed cylindrical clutch 71.

The bottom end of the cross rod 3 slides over the bottom joint 8, the upper toothed cylindrical clutch 71, the lower toothed cylindrical clutch 72 and the spring 73 are inserted inside the lower portion of the cross rod 3, the bottom end of the cross rod 3 and the bottom joint 8 are respectively formed with multiple second connecting holes 10, each second pin 200 passes through the second connecting hole 10 of the bottom end of the cross rod 3 and the corresponding second connecting hole 10 of the bottom joint 8 to connect the bottom end of the cross rod 3 to the bottom joint 8; a first collar 300 with an inner wall slides over the bottom end of the cross rod 3, the first collar 300 and the upper toothed cylindrical clutch 71 are respectively formed with two connecting holes 20, each pin 301 passes through the connecting hole of the first collar 300 and the corresponding connecting hole of the upper toothed cylindrical clutch 71 to connect the first collar 300 to the upper toothed cylindrical clutch 71; two grooves 31 are formed on the cross rod 3, one for each pin 301 to move along the axis of the cross rod 3; a handle 400 with an inner wall slides outside the first collar 300, the first collar 300 and the handle 400 each has an interface surface and both interface surfaces are provided with matching screw threads 302.

The second connecting portion 812 has a front end provided with external threads 820, the external threads 820 is engaged with a positioning nut 800 for preventing the upper toothed cylindrical clutch 71 from moving axially along the second connection portion 812, and allowing the upper toothed cylindrical clutch 71 to circumferentially rotate around the second connecting portion 812 only; the upper toothed cylindrical clutch 71 slides over the second connecting portion 812, the front end of the second connecting portion 812 is engaged with a positioning nut 800 for preventing the upper toothed cylindrical clutch 71 from moving axially along the second connection portion. The inner wall of the upper toothed cylindrical clutch 71 is provided with two annular grooves at intervals, each groove receives a bearing 900 for fastening connection.

In this embodiment, the umbrella frame 5 has a hinge 500 on the top, the hinge 500 has a connecting portion 501, the connecting portion 501 is formed with an inserting portion 502 capable of rotatably connecting to the cross rod 3, and the top end of the internal tube 9 passes through the top end of the cross rod 3 and is inserted into the connecting portion 501, multiple third connecting holes 503 are respectively formed on the top end of the internal tube 9 and the connecting portion 501, each third pins 503 passes through the corresponding third connecting holes 503 to connect the top end of the internal tube 9 to the connecting portion 501, that is, if the hinge 500 is rotated along the circumferential direction of the internal tube 9 by a hand, the internal tube 9 and the hinge 500 will be rotated simultaneously, while the cross rod 3 is not rotated.

When in use of the umbrella in this embodiment, a right hand holds the handle 400 and then pulls the handle 400 downward along the axis of the cross rod 3, and the lower toothed cylindrical clutch 72 is driven to compress the spring 73 and move downward, so that the looped teeth of the lower toothed cylindrical clutch 72 is separated from the looped teeth of the upper toothed cylindrical clutch 71. At this time, the upper toothed cylindrical clutch 71 may rotate around the cross rod 3, and then the umbrella frame 5 is stirred by a left hand and then allowed to rotate left and right along with the internal tube 9 and the upper toothed cylindrical clutch 71. After the shading angle is adjusted, the right hand is released, the lower toothed cylindrical clutch 72 moves upward for restoring under the action of the reset spring 73 and to engage the upper toothed cylindrical clutch 71 again. Therefore, the operation is very convenient.

Embodiment 2

Figure 6:
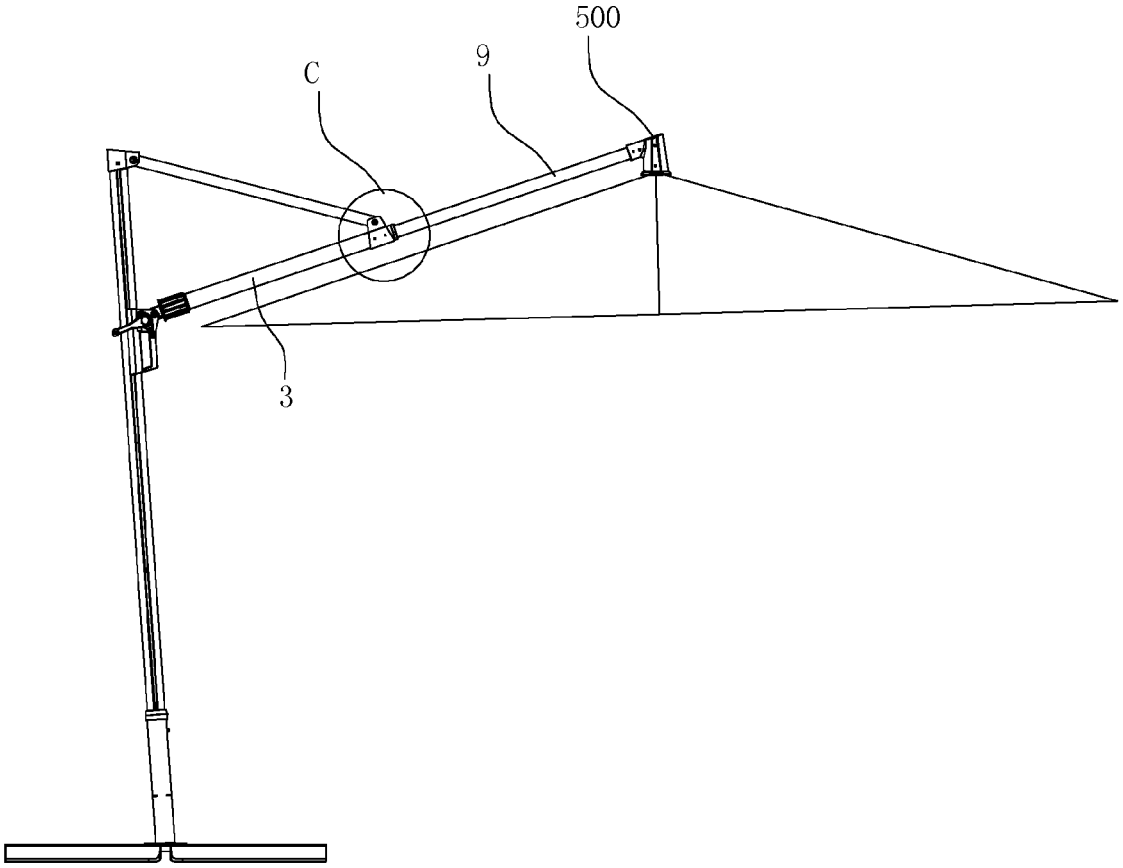
FIG. 6 is a view of the adjustable umbrella in accordance with the second embodiment of the present invention.
Figure 7:
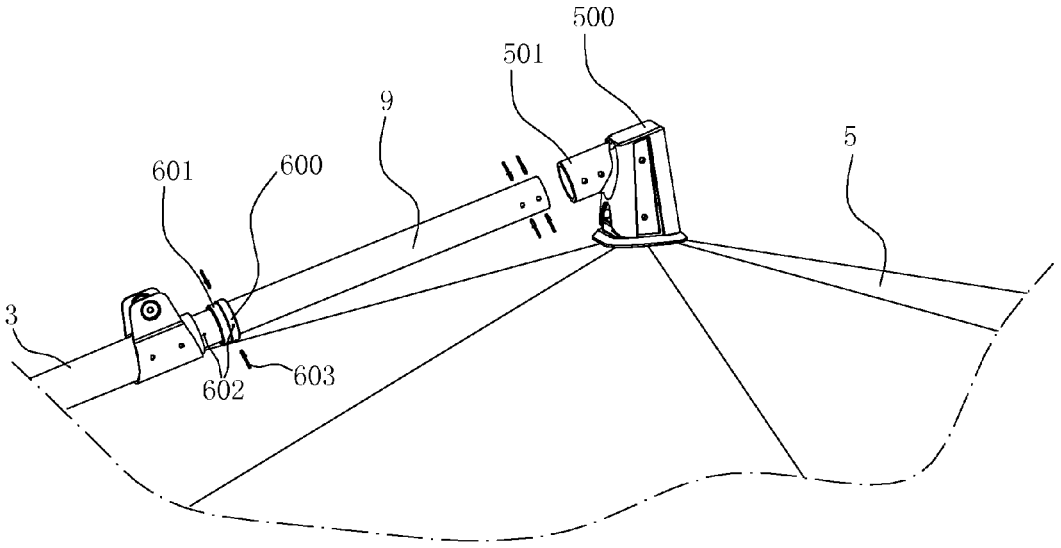
FIG. 7 is a partial exploded view of FIG. 6.
Figure 8:
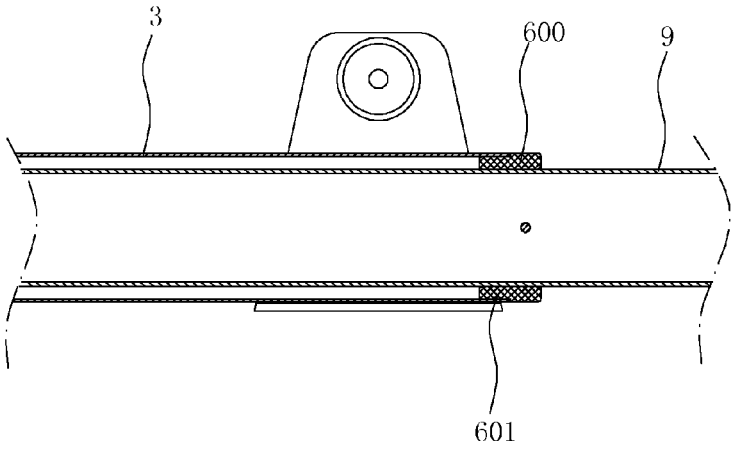
FIG. 8 is a sectional view of region-C in FIG. 6.

The differences between this embodiment and Embodiment 1 lie in that: as shown in FIG. 6, FIG. 7 and FIG. 8, the connecting portion 501 of the hinge 500 is not directly connected to the top end of the cross rod 3, but is fixedly connected to the internal tube 9; meanwhile, the top end of the cross rod 3 is rotatably provided with a second collar 600, the second collar 600 has a second inserting portion 601 rotatably inserted into the cross rod 3, multiple fourth connecting holes 602 are respectively formed on the second collar 600 and the internal tube 9, each fourth pin 603 passes through the corresponding fourth connecting holes 602 to connect the second collar 600 to the internal tube 9.

Embodiment 3

Figure 9:
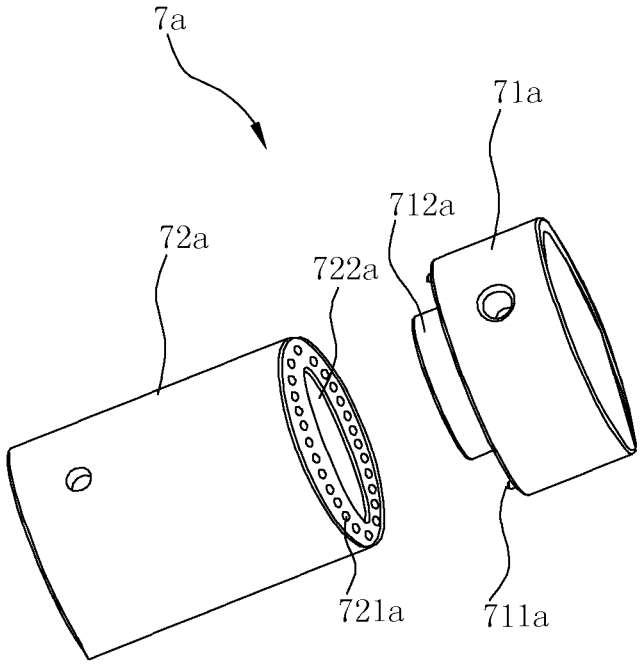
FIG. 9 is an exploded view of an adjusting mechanism in accordance with the third embodiment of the present invention.

The differences between this embodiment and Embodiment 1 lie in that: as shown in FIG. 9, the adjusting mechanism in this embodiment is different from that in Embodiment 1, and the adjusting mechanism 7*a* in this embodiment comprises an upper clutch 71*a* and a lower clutch 72*a*; the cross rod 3 is sleeved outside of the bottom joint 8 and fixed, the internal tube 9 is rotatably disposed inside the cross rod 3, and the bottom end of the internal tube 9 is connected to the upper clutch 71*a*; the upper clutch 71*a* and the lower clutch 72*a* are disposed inside the cross rod 3, the lower clutch 72*a* is connected to the front of the bottom joint 8, and the upper clutch 71*a* is rotatably connected to the front end of the lower clutch 72*a*; the lower clutch 72*a* has a front surface, the front surface is alternately provided with multiple positioning holes 721*a* in circumferential direction, correspondingly, the upper clutch 71*a* has an bottom surface, the bottom surface is provided with a plurality of elastic pins 711*a*, the positioning holes 721*a* receives the elastic pins 711*a*. When in use, rotate the umbrella frame 5 of the top end of the cross rod 3 to drive the internal tube 9 to rotate, and thus drives the upper clutch 71*a* connected to the internal tube 9 to rotate. After the proper shading angle is adjusted, the umbrella frame 5 is stopped rotating, and the elastic pins 711*a* on the upper clutch 71*a* are inserted into the corresponding positioning holes 721*a* for positioning. To ensure the stable rotation between the upper clutch 71*a* and the lower clutch 72*a*, and avoid the disengagement between the upper clutch 71*a* and the lower clutch 72*a*, the center of the front surface of the lower clutch 72 is depressed inward to form a slot 722*a*, and correspondingly, the middle of the bottom surface of the upper clutch 71*a* extends backward to form an extension 712*a* matching with the slot 722*a*; there are two elastic pins 711*a*, and the two elastic pins 711*a* are symmetrically distributed on the bottom surface of the upper clutch 71*a*.

The invention claimed is:

1. An adjustable umbrella, comprising:

an umbrella base;

a stand column removably connected to the umbrella base, the stand column having a top;

a sliding sleeve slidably connected to the stand column;

a cross rod, movably connected to the sliding sleeve and slidable relative to the stand column, having a bottom end, a top end, and a bottom joint, the bottom joint being disposed on the bottom end of the cross rod;

an adjustment mechanism is provided between the bottom joint and the bottom end of the cross rod, comprising an upper toothed cylindrical clutch with a rear end, an outer wall, and an inner wall, a lower toothed cylindrical clutch with a front end and a rear end, and a spring;

a drawing rod having a first end and a second end, the first end of the drawing rod rotatably connected to the top of the stand column, the second end of the drawing rod rotatably connected to the cross rod; and an umbrella frame with a top, wherein the top of the umbrella frame is rotatably attached to the top end of the cross rod, the bottom joint of the cross rod is rotatably connected to the sliding sleeve, the bottom joint has a front that extends forwards to form an extension portion, the lower toothed cylindrical clutch slides over the extension portion of the bottom joint and is capable of moving along the axis of the extension portion, the upper toothed cylindrical clutch is connected to the front end of the lower toothed cylindrical clutch and slides over the extension portion, the front end of the lower toothed cylindrical clutch has a recess with an inner wall for receiving the rear end of the upper toothed cylindrical clutch, the inner wall of the recess and the outer wall of the upper toothed cylindrical clutch are provided with matching looped teeth;

the spring slides over the extension portion and is disposed between the bottom joint and the rear end of the lower toothed cylindrical clutch, the spring is able to move the lower toothed cylindrical clutch to engage the upper toothed cylindrical clutch;

an internal tube is rotatably disposed inside the cross rod, the internal tube has a top end and a bottom end, the bottom end of the internal tube is connected to the adjustment mechanism, the top end of the internal tube is connected to the top of the umbrella frame.

2. The adjustable umbrella of claim 1, wherein the bottom end of the cross rod slides over the bottom joint, the upper toothed cylindrical clutch, the lower toothed cylindrical clutch and the spring are inserted inside the cross rod;

the adjustment mechanism further comprises a first collar, the first collar engages the lower toothed cylindrical clutch by a pin, a groove is formed on the cross rod for the pin to move along the axis of the cross rod.

3. The adjustable umbrella of claim 2, wherein the adjustment mechanism further comprises a handle with an inner wall, the handle slides outside the first collar, the first collar and the handle each has an interface surface and both interface surfaces are provided with matching screw threads.

4. The adjustable umbrella of claim 2, wherein the extension portion is composed of a first connecting portion connected to the front of the bottom joint, and a second connecting portion connected to the first connecting portion, the first connecting portion has a front surface, the second connecting portion has a front end;

the upper toothed cylindrical clutch slides over the second connecting portion, and the upper toothed cylindrical clutch has a back surface that matches with the front surface of the first connecting portion after assembly;

the front end of the second connecting portion is engaged with a positioning nut for preventing the upper toothed cylindrical clutch from moving axially along the second connection portion.

5. The adjustable umbrella of claim 4, wherein the inner wall of the upper toothed cylindrical clutch is provided with two annular grooves, each groove receives a bearing for fastening connection.

6. The adjustable umbrella of claim 4, wherein the first connecting portion has a polygonal shape, and the lower toothed cylindrical clutch has an inner wall in polygonal shape for matching with the first connecting portion.

7. The adjustable umbrella of claim 1, wherein the umbrella frame has a hinge on the top, the hinge has a connecting portion, the connecting portion is formed with an inserting portion capable of rotatably connecting to the cross rod, and the top end of the internal tube is inserted into the connecting portion and fixed.

8. The adjustable umbrella of claim 1, wherein the top end of the cross rod is rotatably provided with a second collar, and the second collar is fixed with the internal tube; the umbrella frame has a hinge on the top, the hinge has a connecting portion, and the top end of the internal tube is inserted into the connecting portion and fixed.

* * * * *